United States Patent [19]

Andres

[11] 4,274,264

[45] Jun. 23, 1981

[54] CHILLER CONTROL

[75] Inventor: Robert W. Andres, Burnsville, Minn.

[73] Assignee: Owens Service Corporation, Minneapolis, Minn.

[21] Appl. No.: 117,393

[22] Filed: Feb. 1, 1980

[51] Int. Cl.[3] ..... F25B 15/00; F25B 41/00; F25B 1/00

[52] U.S. Cl. ..... 62/148; 62/158; 62/211; 62/212; 62/213; 62/217; 62/228; 62/201

[58] Field of Search ..... 62/141, 148, 228, 203, 62/208, 209, 210, 211, 213, 476, 158, 212, 228 C, 201

[56] References Cited

U.S. PATENT DOCUMENTS

| | | | |
|---|---|---|---|
| 2,948,124 | 8/1960 | Embury, Sr. | 62/104 |
| 3,250,084 | 5/1966 | Anderson | 62/210 X |
| 3,750,419 | 8/1973 | Bawel | 62/141 |
| 3,837,174 | 9/1974 | Miyagi et al. | 62/141 |
| 3,864,930 | 2/1975 | Hopkins | 62/101 |
| 3,895,499 | 7/1975 | Hopkins | 62/141 |
| 4,090,372 | 5/1978 | Lamb | 62/141 |
| 4,164,128 | 8/1979 | Newton | 62/209 |
| 4,202,181 | 5/1980 | Lamb | 62/141 |

*Primary Examiner*—William E. Wayner
*Assistant Examiner*—Harry Tanner
*Attorney, Agent, or Firm*—Schroeder, Siegfried, Ryan, Vidas, Steffey & Arrett

[57] ABSTRACT

A control means is disclosed that is used with a closed refrigeration system having a chiller and a condenser to provide refrigeration to chill the fluid medium and a refrigerant pump for pumping the refrigerant through the system with refrigerant capacity control means determining the capacity of the refrigerant, the control means for the system using signal inputs representative of outside air temperature, return chilled water temperature, supply chilled water temperature, and condenser temperature, in which settable controllers are used to determine the optimum temperature signals for controlling the system at any given time. A timer is also connected to the control mechanism for alternately interrupting an optimum temperature signal to reduce the overall change in the control signal. Additional control may be obtained through the use of signals representative of humidity, strong solution temperature and cooling water output pressure.

22 Claims, 4 Drawing Figures

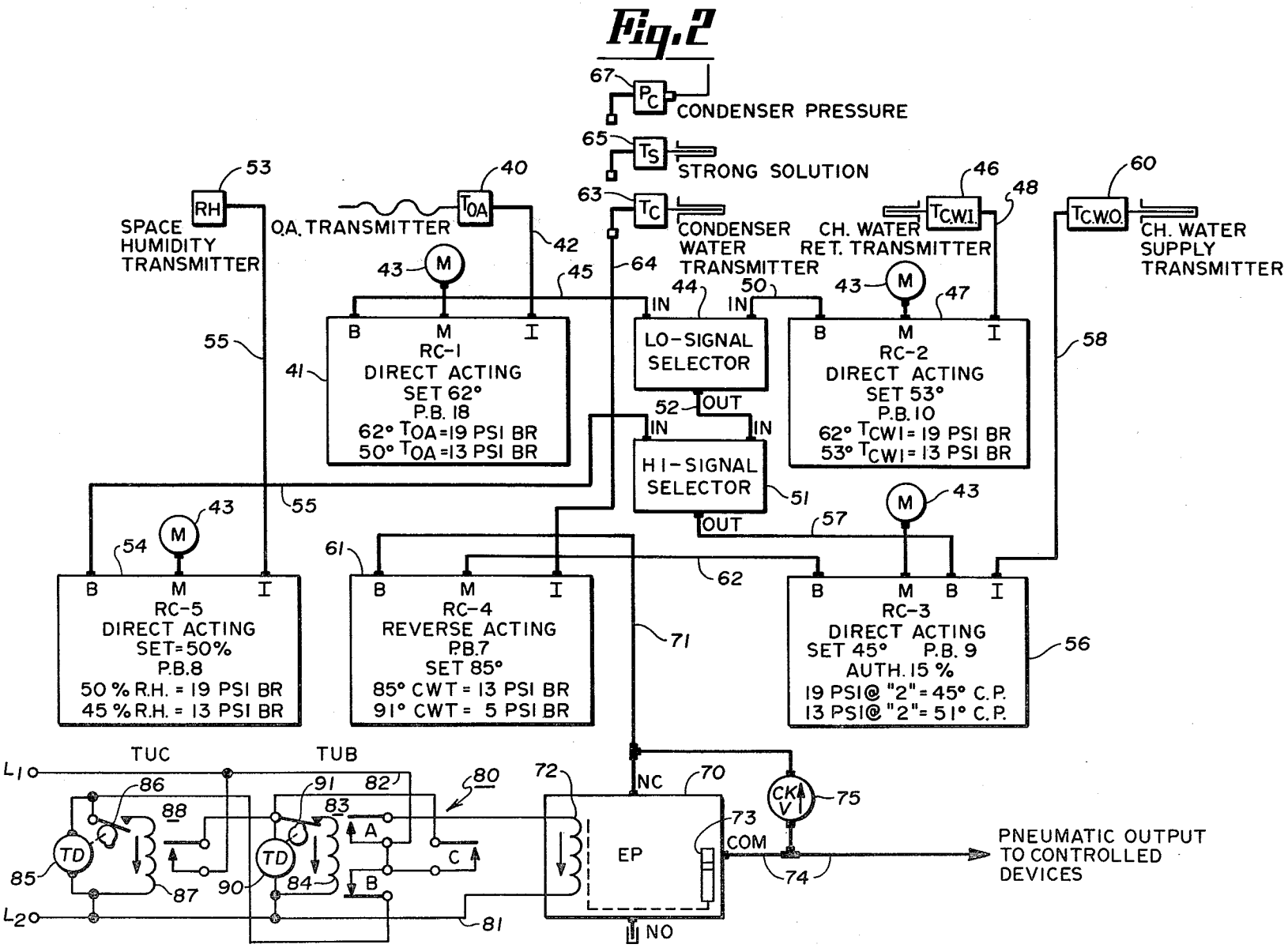
Fig. 2
CONDENSER PRESSURE
STRONG SOLUTION
CONDENSER WATER
CH. WATER RET. TRANSMITTER
CH. WATER SUPPLY TRANSMITTER
O.A. TRANSMITTER
SPACE HUMIDITY TRANSMITTER
LO-SIGNAL SELECTOR
HI-SIGNAL SELECTOR
RC-1 DIRECT ACTING SET 62° P.B. 18 62° TOA=19 PSI BR 50° TOA=13 PSI BR
RC-2 DIRECT ACTING SET 53° P.B.10 62° TCWI=19 PSI BR 53° TCWI=13 PSI BR
RC-3 DIRECT ACTING SET 45° P.B. 9 AUTH. 15 % 19 PSI@ "2"=45° C.P. 13 PSI@ "2"=51° C.P.
RC-4 REVERSE ACTING P.B.7 SET 85° 85° CWT=13 PSI BR 91° CWT= 5 PSI BR
RC-5 DIRECT ACTING SET=50% P.B.8 50 % R.H. = 19 PSI BR 45 % R.H. = 13 PSI BR
PNEUMATIC OUTPUT TO CONTROLLED DEVICES
EP
TUB
TUC
L1
L2

CHILLER CONTROL

This invention relates to control systems and more particularly to an improved control system for use with refrigeration equipment to provide an optimum operation of a fluid cooled system.

Chillers of the type disclosed herein may be used to chill water or some other fluid medium to provide cooling at a remote location and such systems are generally provided with a temperature senser to sense the temperature of water or other fluid medium which is entering or returning from the chiller.

It is desirable to have stability within the chiller control system and thus it is desirable to provide what is generally known in the art as a throttling range or proportional band as one of the control characteristics of the system. The throttling range or proportional band provides a control characteristic so that the chiller operates in such a manner that it provides a slightly different temperature for one capacity than it does at another. Thus if the chiller is designed to provide a given return chilled water temperature when operating at a maximum capacity, it may be desirable to have a characteristic for the system so that the chiller produces the supply chilled water at a slightly lower temperature when operating at a minimum capacity. This difference in temperature between the maximum and minimum capacity operating condition of the system is generally referred to as the throttling range or proportional band of the control.

When the control means of this invention is used with an absorber, and the air conditioning equipment is not operating at its full capacity because of various inefficient portions of the system such as scaled tubes, clogged strainers, or dirty condensers, the main steam control valve may be cycling in order to produce "colder water" from the steam supplied to the absorber as determined by the temperature signal providing optimum control to the system. The control means is also subject to a superior command which will override all of the demand signals when a given temperature or humidity is in existence. The system lends itself to optimizing the reset chilled water temperature at its highest value without affecting the comfort within the controlled space or zone. In fact, the control means is capable of responding to various limits, depending upon what is considered the optimum controlling factor, using outdoor temperature as a limit, indoor humidity, indoor temperature, or whatever other parameter is desired to establish a high limit.

It is therefore a general object of this invention to provide an improved control system for use with a refrigeration system to reduce the energy requirements to operate the system.

It is a more specific object of this invention to control a chiller or refrigeration system with a control system responding to the most critical of a plurality of temperature changes monitored within the system.

It is still a further object of this invention to use a plurality of temperature sensitive control elements that may be operated within selective limits, reset ratios, and override values to meet the optimum cooling needs of a building.

It is yet another object of this invention to provide a control circuit for a chiller or refrigeration system having at least three temperature signal inputs and a limiting input of condenser temperature or pressure.

It is another object to use a timing mechanism to override the output signals from the control circuit to the chiller or refrigeration system energy controller when the refrigeration system is loading or unloading.

These and other objects and advantages of the invention will more fully appear from the following description, made in connection with the accompanying drawings, wherein like reference characters refer to the same or similar parts throughout the several views, and in which:

FIG. 2 is a schematic diagram of the preferred control system representative of the invention;

The control system of this invention operates in a manner that reduces fuel input to the refrigeration system whenever the system is operating inefficiently. The control system responds to the various inputs to the system in response to changes in the load of the refrigeration system which further helps reduce fuel consumption of the refrigeration system.

Figure 1:
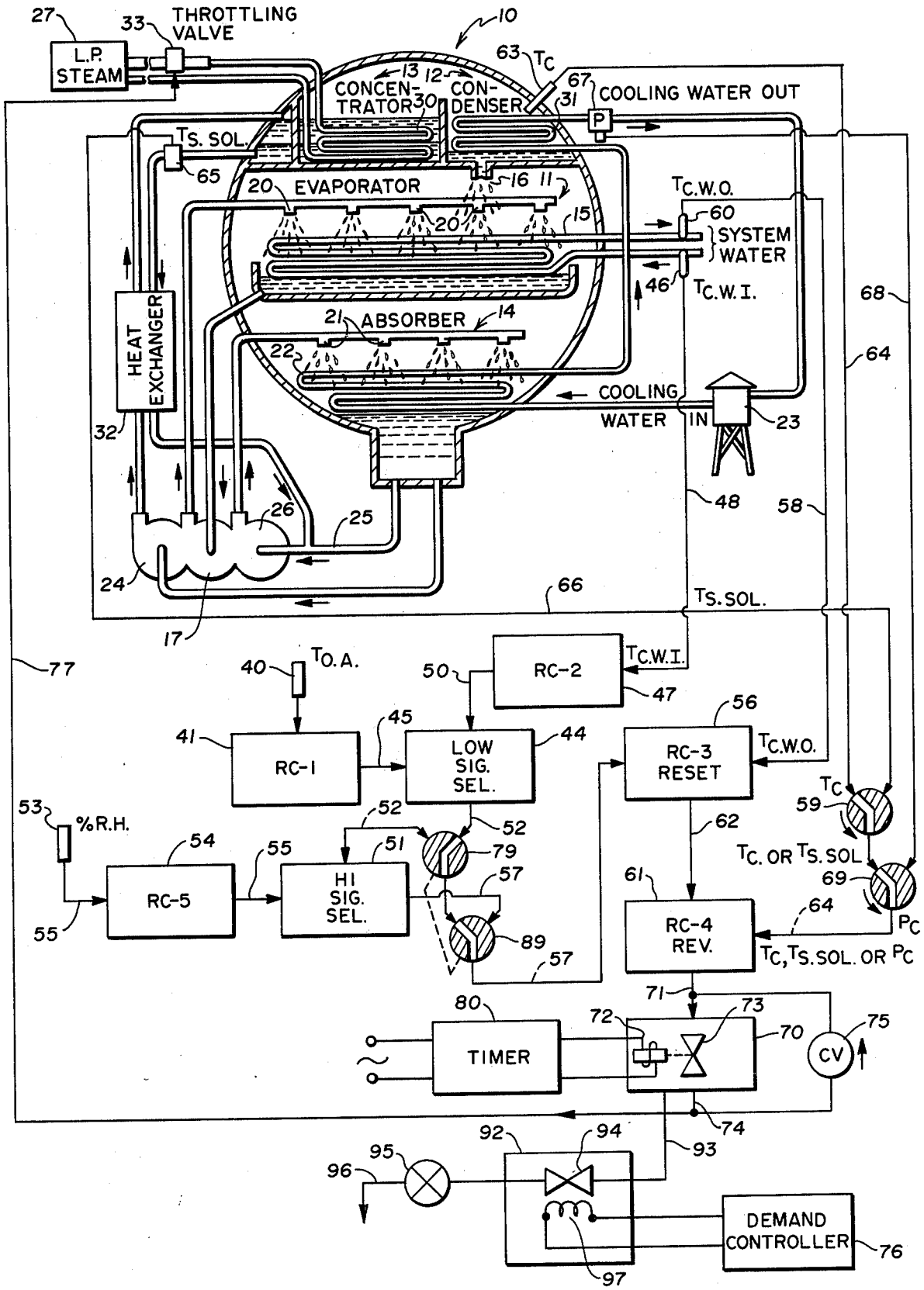
FIG. 1 is a diagrammatic view illustrating a preferred control system of the invention as used with an absorption-type refrigeration system.

Referring now to FIG. 1 generally, it will be observed that a conventional refrigeration system 10 is disclosed which uses an evaporator 11, a condenser 12, a concentrator 13, and an absorber 14 of the absorption-type refrigeration system. The operation of the absorption-type system will be described briefly and further explanation of the absorption-type system may be found in U.S. Pat. No. 4,090,372. The fluid medium, in this case water, to be chilled is circulated through a coil 15 in evaporator 11, although other liquids may be used in place of water.

A refrigerant enters evaporator 11 from condenser 12 through an orifice 16 and because the evaporator pressure is maintained at a lower level, a certain amount of vaporization occurs when the refrigerant passes through orifice 16. Upon vaporization of the refrigerant, it absorbes its latent heat of vaporization, thereby cooling and condensing the remainder of the refrigerant which collects at the bottom of evaporator 11. The liquid refrigerant enters an evaporator pump 17 and is pumped to a number of orifices or spray trees 20 of evaporator 11. The refrigerant is sprayed on coil 15 and upon contacting coil 15 extracts heat from the water which causes the system water to become cooler and causes the refrigerant to boil. The vaporized refrigerant then passes into absorber 14 which is maintained at a pressure slightly lower than the pressure in evapirator 11. In a similar manner, an absorbent having a strong affinity for the refrigerant with a boiling point much higher than the refrigerant is sprayed through a plurality of spray trees 21 onto the refrigerant vapor. A commonly used refrigerant-absorbent is water and lithium bromide (LiBr).

The refrigerant vapor which leaves the evaporator in absorber 14 condenses the liquid LiBr solution to form a dilute solution which collects at the bottom of absorber 14 and the heat of condensation given up by the refrigerant during this process is removed by condensing water which passes through a coil 22 disposed in the absorber 14 where the cooling water may come from a cooling tower. The dilute solution at the bottom of the absorber 14 is directed to another pump 24 that pumps the solution into concentrator 13 where the refrigerant is boiled out of the dilute solution, producing a concentrated refrigerant-absorber solution. The concentrated lithium bromide solution is then mixed with the dilute solution in a line 25 and is passed to the input of an absorber pump 26 which pumps the intermediate solution into absorber 14 through spray trees 21.

Because it is necessary to apply heat to the dilute solution in concentrator 13 to raise the temperature high enough to drive out the water vapor, it is accomplished by circulating steam from a lower pressure steam source 27 through a coil 30 disposed in concentrator 13. Water will generally boil out of the dilute solution at about 210 degrees Fahrenheit while the boiling point of lithium bromide is approximately 1500 degrees Fahrenheit. The water vapor boiled from the lithium bromide solution in concentrator 13 passes to condenser 12 where the pressure is somehwat lower than that in concentrator 13.

A condenser coil 31 has cooling water circulated through it and is disposed in condenser 12, being the same water passage line as that passing through coil 22 and returning to the cooling tower 23.

The vaporized refrigerant is cooled and condensed upon contacting coil 31 and the liquid refrigerant again eventually passes through orifice 16 into the evaporator 11, thus completing the refrigerant cycle.

A heat exchanger 32 heats the stream of dilute solution to drive out the refrigerant in concentrator 13 and upon return to pump 26, the concentrated lithium bromide solution passes through heat exchanger 32 to be cooled to maintain a constant absorber temperature.

Thus the capacity of the refrigeration equipment may be controlled by regulating the concentration of the solution entering absorber 14 and this is generally done through the use of a temperature sensor for the cooling water supply or output line which is then used to control the amount of steam to concentrator 13 through a throttling valve 33. Upon detecting a rise in the supply water output temperature, throttling valve 33 is opened to increase the heat applied to concentrator 13 to increase the cooling capacity of the system 10. On the other hand, if the temperature sensor in the cooling supply water detects a drop in temperature, the throttling valve would be closed to reduce the heat input to concentrator 13, resulting in a decrease in the concentration of the solution to absorber 14.

Control of a refrigeration system in the manner just specified includes a very inefficient operation because the system is designed to maintain the supply water at a constant temperature regardless of the load on the system. Assuming the system load decreases, as just described, the system would react by decreasing the concentration of the intermediate solution and reducing the cooling capacity of the system. In other words, the system compensates for the reduced load by reducing the temperature differential between the supply cooling water and the return water, while maintaining the temperature of supply cooling water at a constant low temperature, resulting in a wasteful use of fuel because additional steam is required to reduce the temperature of the return water.

Some stability to the refrigeration control system may be obtained through what is known in the prior art as a throttling range or proportional band in the control characteristic of the system. A proportional band provides a control characteristic through the use of a temperature differential so that the refrigeration machine may operate at a different temperature for one capacity, and at another temperature for a different capacity. Thus if the refrigeration system provides a particular cooling water supply temperature when operating at its maximum capacity, the system may be said to produce a water temperature which is several degrees lower than that when operating at the minimum capacity. That difference in temperature between the maximum and minimum capacity operating condition of the system is referred to as the throttling range or proportional band of the control and is highly desirable in maintaining an energy efficient system. However, a fine control over a refrigeration system is required where, for example, centrifugal compressors may exhibit an undesirable characteristic of surging at very light loads. Thus it is highly desirable to be able to set the throttling range or proportional band of the various controls in the control system to achieve an optimum performance. Additionally, the prior art systems do not have the capabilities of detecting internal system deficiencies as described earlier.

The control system which is used to conserve energy will now be described with particular reference being paid to FIGS. 1 through 3. An outside air temperature sensor 40 provides a signal representative of the outside air temperature to a pneumatic amplifier 41, designated RC-1. Temperature sensor 40 may be of the type manufactured by the Barber Coleman Company of Rockford, Ill., Part No. TKS2031 that is a direct acting temperature transmitter having a general range of minus 40 degrees F. to 160 degrees F. The transmitter is a proportional-type transmitter having an output from 3 to 15 psig. The pneumatic directing acting receiver and amplifier is a force balanced pneumatic amplifier and includes proportional band and reverse action that is field adjustable. Such a component is the model RKS1001 manufactured by Barber Coleman Company, Rockford, Ill., and its input is connected through a pneumatic line 42 from outside air temperature sensor or transmitter 40. A main source of air under pressure 43 has a pneumatic line connecting it to the designation "M" and generally has a supply pressure of approximately 20 pounds per square inch. The direct acting amplifier 41 has a proportional band (P.B.) of 17 indicating the number of degrees change in Fahrenheit to get a ten psi branch line change. The set point for the amplifier is 62 degrees F. and its temperature characteristics provide 19 psi at 62 degrees F. $T_{OA}$ and provides 13 psi for 50 degrees F.$T_{OA}$. The output of amplifier 41 is sent to a low signal selector 44 through a branch line 45.

A cooling water return transmitter or sensor 46 sends a pneumatic signal to another direct acting pneumatic amplifier 47 through a pneumatic line 48. Pneumatic amplifier 47 is also a direct acting amplifier and is like the receiver controller and amplifier 41, a suitable component being model RKS1001, manufactured by Barber coleman Company, Rockford, Ill. Mainline pressure source 43 is also connected to amplifier 47. The operating characteristics of pneumatic amplifier 47 include a proportional band of 10 with a set point of 53 degrees F. and a cold water return temperature ($T_{CWI}$) of 60 degrees F., producing a branch line pressure of 19 psi, and 53 degrees F. ($T_{CWI}$) developing 13 psi branch line pressure. Temperature transmitter 46 has a range of zero to 100 degrees F. and one suitable model has been found to be Part No. TKS8014 manufactured by the Barber Coleman Company of Rockford, Ill. The output signal from settable amplifier 47 is sent to low signal selector 44 through a connecting pneumatic branch line 50. Low signal selector 44 may be in the form of a pneumatic relay that selects the lower of two pressures and transmits the lower signal. One such mechanism is manufactured by Honeywell and is Model No. RP970A, wherein pneumatic lines 45 and 50 are connected to the main and pilot ports of the low signal selector and the branch port is connected to a high signal selector 51 through a branch line 52, the exhaust port not being connected. The lower signal selector then transmits the lower of the two input pressures from amplifiers 41 or 47.

A relative humidity transmitter 53 develops a pneumatic signal and transmits the signal to another direct acting pneumatic amplifier 54 through a pneumatic branch line 55. The humidity sensor or transmitter 53 may sense the humidity in a room or in the duct work of a forced air supply system. One suitable model is a proportional pneumatic transmitter, Model No. HKS5033 also manufactured by the Barber Coleman Company and producing an output signal of 3–15 psig for 10 to 90 percent relative humidity. Pneumatic amplifier 54 also is connected with a main air supply 43 having an input of 20 psi. Pneumatic amplifier 54 is a direct acting settable amplifier in which the set point is at 50 percent humidity with a proportional band of 8 wherein 50 percent relative humidity produces a 19 psi branch line signal and 45 percent relative humidity produces a 13 psi branch line signal. Pneumatic amplifier 54 may be Model RKS1001 manufactured by Barber Coleman Company of Rockford, Ill., as described previously. The output of pneumatic amplifier 54 is applied to one of the inputs of the high signal selector 51 through a branch line 55.

High signal selector 51 may be of a type manufactured by Honeywell, Model No. RP470A, wherein the branch lines are connected to the inlet, main, and pilot ports and the outlet branch is connected to a dual input receiver-controller 56 that permits a compensated signal to reset the set point of the receiver controller. The output from the high signal selector 51 is connected to the secondary input through a pneumatic branch line 57. A suitable control for the dual input receiver 56 is Model RKS3002 manufactured by Barber Coleman Company, Rockford, Ill., and in this case, is resettable with an authority of 15 percent of the primary signal arriving at input 1 through another pneumatic branch line 58 that is connected to a cooling water supply transmitter or temperature sensor 60. The characteristics of the dual input receiver 56 are such that 19 psi at input No. 2 is representative of a 45 degree F. control point and 13 psi at input No. 2 is representative of a 51 degree F. control point. Temperature sensor and transmitter 60 is the same as sensor 46. Receiver 56 is also connected to the main source of air pressure 43.

Temperature sensor 60 measures the cooling supply water that is sent to the system to be cooled. The output of the new input receiver controller 56 is sent to a reverse acting single input receiver controller 61 through a pneumatic branch line 62. Receiver controller 61 may be of the type manufactured by Barber Coleman Company, Rockford, Ill., as Model RKS 1001 in which the output signal is reversed to accomplish a direct reset in which a one-to-one ratio is maintained, that is, where the output pressure is decreased on a rise of equal amount for the input pressure. Pneumatic branch line 62 is connected to the normal main air pressure input of the reverse acting receiver controller 61.

A condenser water temperature transmitter or sensor 63 is connected to the input of reverse acting receiver 61 through a pneumatic branch line 64. Condenser sensor 63 may be of the type manufactured by Barber Coleman Company, Rockford, Ill., having Part No. TKS-8017, with a general range of 50 to 150 degrees F.

The characteristics of reverse acting receiver 61 include having a proportional band of 7 with a set point of 85 degrees F. representative of the condenser water temperature for 13 psi branch line pressure and for 91 degrees cooling water temperature, a pressure of 5 psi branch line pressure.

In some cooling systems, it may be desirable to substitute two other parameters for that of the condenser water temperature. For instance, a strong solution temperature sensor 65 may be employed which measures the temperature of the solution that enters the concentrator 13. The pneumatic pressure signal could be connected to reverse acting receiver 61 through a suitable pneumatic branch line 66 (as disclosed in FIG. 1), or if the condenser water temperature was not being sensed, pneumatic branch line 64 could be used. In a similar manner, it may be desirable to sense the condenser cooling water pressure through a sensor 67 that would be connected to the input of reverse acting receiver 61 through a pneumatic branch line 68 (as disclosed in FIG. 1). It will also be recognized that if neither the condenser water temperature nor strong solution temperature is being used as an input to reverse acting receiver 61, pneumatic branch line 64 may be used. Temperature sensor 65 may be Model TKS-8033 manufactured by the Barber Coleman Company, having a temperature range of 40°–240° F., and pressure sensor 67 may be of the type manufactured by Honeywell under part number PP97A.

The output from reverse acting receiver 61 is applied to an electrical-pneumatic control mechanism 70 through a pneumatic branch line 71. The electrical to pneumatic transducer 70 has a solenoid coil 72 contained therein that operates a valve 73 (shown schematically) to control the pneumatic output on a pneumatic line 74. A check valve 75 is connected between output pneumatic line 74 and input line 71. The output lines may be connected to a demand controller 76 which will be described in more detail with the output from the demand controller being connected to throttling valve 33 through a suitable pneumatic line 77. The solenoid coil 72 of the electrical to pneumatic transducer 70 is controlled by a timer 80 which will now be described in greater detail by reference to FIG. 2.

Timer 80 is made up of two time delay circuits designated "TUC" and "TUB". These two series of time delay relays are like those manufactured by Diversified Electronics, Inc. of Evansville, Ind., where the TUB series are known as interval "on" operated timers. Contacts of the internal relay close for an interval of time after voltage has been applied to the relay. If voltage is removed from the circuit, the timer returns to zero and the electrical contacts return to their de-energized state. The TUC series are delay "on" timers that will not actuate the relay contacts until completion of the timing cycle, even if power is removed. Upon voltage being applied, the delay period begins and upon the completion of the time delay period, the relay contacts are closed. When voltage is removed from the circuit, the relay returns to its normal de-energized condition. The time delay circuit 80 will now be described in which power is applied between terminals 1 and 2, terminal 2 being connected to a common lead 81 which is also connected to one terminal of solenoid coil 72. Terminal 1 is connected to a line 82 that terminates at three fixed contacts, A, B, and C of a relay 83 having an operating coil 84. The armatures of relay contacts 83 are normally open for contacts A and C and is normally closed with contact B. Armature B of relay 83 is electrically connected to a time delay motor 85 of the TUC section of the timer and the time delay motor has its other terminal connected to the common lead 81, thus applying power to time delay motor 85. The time delay period for the TUC portion of timer 80 is 2–200 seconds, while the period of operation for the TUB section is 0.1–10 seconds. With the circuit just described, time delay motor 85 operates until an optimum time of approximately 120 seconds, at which time a cam closes a switch contact 86, completing the circuit between terminals 1 and 2 for a relay coil 87 of a relay 88. Closing the contacts on relay 88 applies voltage to a second time delay motor 90 of the TUB section of the timer 80. Relay coil 84 is in parallel with time delay motor 90 and upon being energized, contacts B are opened and contacts A and C are closed. Upon opening contacts B of relay 83, power is removed to time delay motor 85 and to coil 87, thus opening the contacts of relay 88 that provided power to time delay motor 90. An alternate circuit through closed contacts C of relay 83 continues power to time delay motor 90 and through the closing of contacts A of relay 83, coil 72 is energized in the electrical to pneumatic transducer 70. Thus coil 72 is energized for approximately 0.03 of a second through the use of valve 73 and check valve 75, when the pressure in output line 74 is higher than the incoming pressure on line 1, the pressures are equalized for a brief interval to smooth out any large swings in pressure. Thus any fluctuations are smoothed to provide a smoother control at the output. Upon time delay 90 running its full delay period, a cam driven switch 91 is opened, thus de-energizing the circuit and causing time delay motor 90 to return to its original position.

In some installations, a demand controller 76 may be installed and it may be desirable to use the demand controller with the invention. Under those conditions, another electrical to pneumatic transducer 92 may be installed in which another pneumatic branch line 93 is connected to the electrical transducer in which a solenoid operated valve 94 is connected. The valve is also connected through a pneumatic line to a restricter valve 95 that may be manually set or adjustable for the correct orifice and valve 95 exhausts to the atmosphere through a line 96. A solenoid coil 97 used in conjunction with valve 94 is connected to demand controller 76. Electrical to pneumatic transducers 70 and 92 may be of the type designated V-11HAA manufactured by Penn Controls, Oakbrook, Ill.

Demand controller 76 may be either the type used for control of steam or electric power, such as that manufactured by Honeywell, Model W970A, used to reduce the utility peak demand rates by limiting the maximum electrical power drawn by a preset level. It also has the capability of reducing the total kilowatt hour consumption by shutting down certain loads. Another such device is manufactured by Pacific Technology, Inc. of Renton, Wash., that supplies a piece of equipment known as "Basic Eight" for managing an electrical load.

Assuming that a fairly high pneumatic signal exists in lines 74 and 77 calling for a large supply of steam through throttling valve 33 into the absorber, as long as solenoid 97 remains unenergized, the amount of steam demanded by the absorber would continue. However, upon receiving a high demand signal from demand controller 76 which may be either a steam or electric demand controller, valve 94 would be actuated and would drain off the pressure from line 74 through the electrical to pneumatic transducer 70 and upon reaching a condition below the setting of the demand controller, the solenoid would then be de-energized and the pneumatic output in line 94 remain at that pneumatic level.

In FIG. 1, signals from the condenser pressure transducer 67 appearing on line 68, from solution temperature signals from transducer 65 appearing on pressure line 66 and the condenser water temperature sensor 63 supplying a signal on line 64 are schematically shown as alternative limiting signals which pass through valves 59 and 69 to supply one of the three signals to reverse acting receiver 61, designated RC-4.

In a similar manner, if the relative humidity is not to be used as a high limit, receiver 54 and high signal selector 51 could be eliminated and the signals would then be transmitted as shown in FIG. 1. On the other hand, with the relative humidity being used as a high limit, a pair of valves 79 and 89 shown schematically would be rotated to include the pneumatic signals as described previously with respect to FIG. 2.

Figure 3:
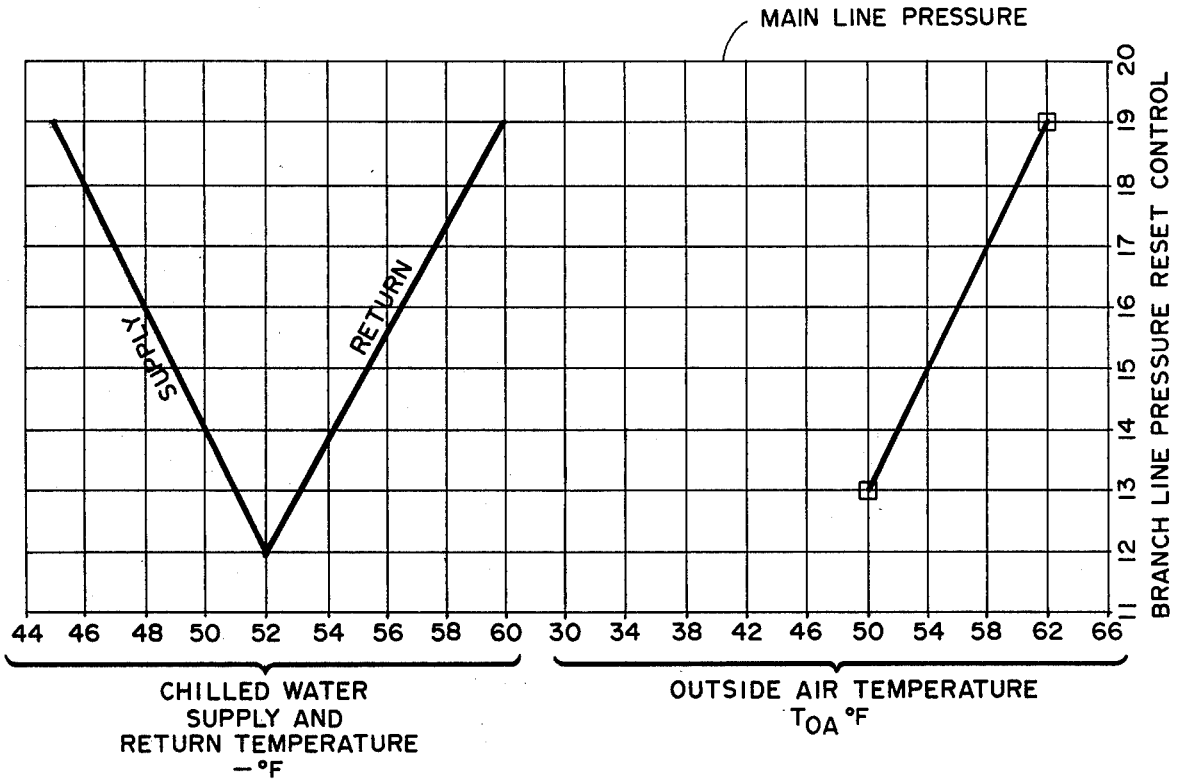
FIG. 3 is a graph illustrating the temperature control characteristics of the control system as a function of the branch line control pressures.
Figure 4:
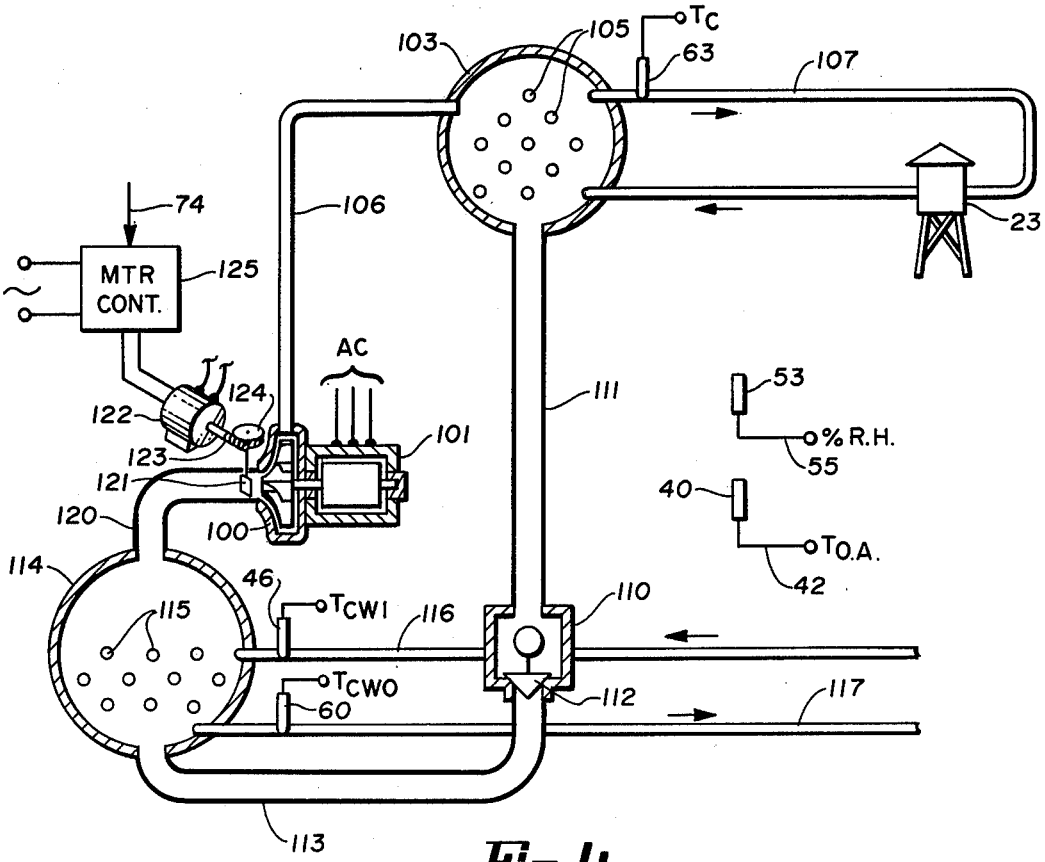
FIG. 4 is a diagrammatic view illustrating a centrifugal refrigeration system having sensors disposed in the system to provide temperature and humidity signals for use in the preferred control system of the invention.

Reference is now made to FIG. 3 wherein a centrifugal refrigeration system is disclosed using the appropriate sensors which have been described previously. The refrigeration system includes a centrifugal compressor 11 driven by an electrical motor 101 through a suitable power means. A condenser 103 receives water to be cooled in an inlet line 104 from cooling tower 23 and also contains temperature sensor 63 for sensing the temperature of the condenser water. A plurality of internal tubes 105 condense refrigerant which moves from compressor 100 through a hot gas line 106. An outlet line 107 returns the warmer cooling water to tower 23. Liquid from condenser 103 moves to an accumulator 110 through a liquid line 111. Accumulator 110 makes use of a suitable valve 112 for metering the flow of refrigerant through a liquid line 113 to an evaporator 114. Evaporator 114 includes a housing having a plurality of internal tubes 115 that are connected with a chilled water input line 116 and a chilled water output line 117. Line 116 contains sensor 46 measuring the chilled water return and a sensor 60 in line 17 measures the temperature of the chilled water or supply water going to the cooling system. Heat is carried from the local heat exchangers into evaporator 114 where it passes through the walls of tubes 115 and gives up its heat to the liquid refrigerant, causing the refrigerant to vaporize or boil. Upon vaporizing, the refrigerant is passed through a vapor line 120 and inlet guide vanes 121 at the entrance to the compressor where the cycle may be repeated.

The capacity of the refrigeration system is controlled by the position of guide vanes 121 which may be used to throttle the refrigerant flow to the compressor. That is, when guide vanes 121 are fully opened, a maximum volume of refrigerant is permitted to flow through the compressor and the system operates at maximum capacity. When a lower capacity is required, guide vanes 121 are adjusted to a position that restrict the flow of refrigerant to the compressor and thus the system capacity is reduced. Guide vanes 121 are adjusted by a convenient means such as through the use of a motor which is connected to an electrical source and may also be of a pneumatic, hydraulic or other type motor subject to control. Motor 122 is shown connected to a shaft having a worm gear 123 in communication with a gear 124 that is connected to an appropriate shaft communicating with vanes 121. Motor 122 has a pair of input electrical control lines that apply an electrical voltage from a motor controller 125. Motor controller 125 is connected to an alternating source of voltage and receives a signal from the pneumatic output line 74 wherein the pneumatic signal is converted to an electrical signal to control the direction of rotation of motor 122 that is related to the increase or decrease of the pneumatic signal received in line 74. Thus motor controller 125 will cause motor 122 to rotate in one direction to open vanes 121 and rotate in the other direction to close vanes 121.

Returning to the control circuit as shown generally in FIG. 2 and the operating characteristics of a particular embodiment, it will be noted that if the outside air temperature is between the range of 50 degrees and 62 degrees F., the cooling system will be started. If the temperature drops below 50 degrees for the outside air temperature, the cooling system will stop, no matter what the rest of the system may call for. With an outside temperature of 62 degrees, the branch line pressure from controller 41 would be 19 psi and if the temperature were at 60 degrees F., the branch line pressure on line 45 would be 18 psi. Should the temperature go above 64 degrees, the main line pressure of 20 psi would emerge as the controlling pressure on line 45. Reset controller 41 is to be reset at 60 degrees F. Assuming that the outside air temperature is 62 degrees, the 19 psi pressure signal would be applied to the low signal selector 44 where there would be an attempt to maintain the chilled water return temperature of the 60 degrees F. and a supply water temperature of 45 degrees F. In other words, the return water temperature would be used to control the system because the low signal selector 44 would be choosing the lower signal wherein the signal from reset controller 47 would be providing a signal lower than that from reset controller 41. For instance, if the return water temperature for the particular building was 54 degrees as indicated by sensor 46, the pressure emerging on line 50 would be approximately 14 psi. A 14 psi signal would permit the system to control or attempt to maintain a 50 degree F. supply water signal. If the return water temperature is 55 degrees F., there would be an attempt to have the supply water be controlling at approximately 49.25 degrees F. At 56 degrees return water temperature, an attempt would be made to maintain the supply water temperature at approximately 48.50 degrees F. However, in certain buildings the temperatures would have to be maintained at a lower value to prevent losing the load in the building and the full 10 degree spread of the proportional band would then be used to attempt to maintain the supply water at 46 degrees F. In other words, the slopes of the two curves could be changed by the use of the separate controllers and the proportional bands can also be changed.

As will be seen by taking the signals from reset controllers 41 and 47, with a high outside air temperature, the signal emerging from controller 47 will be in control and will dominate the low signal selector providing the signal to the high signal selector 51 as representative of the chilling water return temperature. Further assuming that the space humidity signal is sufficiently low, the signal appearing on line 55 will then be the lowest input signal to high signal selector 51 and the return water temperature signal will then be applied to reset controller 56. Reset controller 56 has an input from the chilling water supply temperature sensor and through the use of the set point of 45 degrees and the 15 percent authority, the output signal is then applied to a reverse acting reset controller that also includes a signal representative of the condenser water temperature. Reset controller 56 thus makes a selection between the signal's highest magnitude, keeping in mind the authority setting permits a 15 percent increase of the signal appearing on the input line 58 and that the output signal is applied to reverse acting reset controller 61. That same reverse acting controller receives an input signal from the condenser water transmitter that is decreased at the output on a one-to-one basis for the rise received. Thus the output from reverse acting reset controller 61 will compare the different inputs and leave the return chilled water temperature in control unless overridden by the supply water temperature or condenser water temperature.

The output signal is then sampled through the use of the timer by the electrical to pneumatic transducer 70 and the output applied to the proper controllable mechanism such as throttling valve 33 or motor controller 125 to maintain the optimum capacity of the cooling system.

It will, of course, be understood that various changes may be made in the form, details, arrangement and proportions of the parts without departing from the scope of the invention which consists of the matter shown and described herein and set forth in the appended claims.

What is claimed is:

1. A control means for a refrigeration system using a refrigerant to chill a fluid medium through a closed system having a chiller and a condenser, the chiller receiving the fluid medium to be chilled and discharging the fluid medium upon being chilled, refrigeration means in communication with the chiller and condenser to provide refrigeration to chill the fluid medium in the chiller, refrigerant pump means in communication with the refrigeration means for pumping the same through the system, refrigerant capacity control means in communication with the refrigerant for controlling the refrigeration capacity of the refrigerant, and a control means operably connected to said refrigerant capacity control means for controlling the refrigeration system, said control means comprising:

(a) first temperature sensor means providing an output signal representative of the outside air temperature;

(b) first amplifier means operably connected to said first sensor means providing an amplified signal representative of the outside air temperature;

(c) second temperature sensor means providing an output signal representative of the return chilled water temperature;

(d) second amplifier means operably connected to said second sensor means providing an amplified signal representative of the returned chilled water temperature;

(e) a low signal selector means operably connected to said first and second amplifier means providing an output signal representative of the lowest amplitude of said temperature signals;

(f) third temperature sensor means providing an output signal representative of the supply chilled water temperature;

(g) a dual input settable controller operably connected to said third temperature sensor and to said low signal selector means to provide an output signal representative of the increase or decrease in amplitude from the set point of said settable controller;

(h) fourth sensor means sensing a distinct overriding condition and providing an output signal representative of said condition, said signal having an amplitude for overriding the amplitude of said other output signals;

(i) a reverse signal settable controller operably connected to said fourth sensor means and to said dual input settable controller providing a signal representative of the reverse change in amplitude from the set point of said reverse signal settable controller;

(j) and a control mechanism having an input operably connected to said reverse signal settable controller and an output operably connected to the refrigerant capacity control means, said control mechanism providing a signal representative of the capacity of said refrigeration system.

2. The control system of claim 1 wherein each of said first and second amplifier means are settable controllers.

3. The control system of claim 1 wherein said first and second amplifier means, and said dual input and reverse signal settable controllers have operating characteristics including proportional bands of operation.

4. The control system of claim 3 wherein said proportional bands of operation are distinct for each of said amplifier means and said settable controllers.

5. The control system of claim 3 wherein each of said proportional bands of operation are settable to different operating conditions.

6. The control system of claim 1 including:

(k) a directional signal mechanism connected in parallel with the input and output of said control mechanism to equalize the amplitude of said signal at the output with that of the input;

(l) a timer operably connected to said control mechanism for alternately interrupting the signal from said reverse signal settable controller and enabling said directional control signal mechanism.

7. The control system of claim 6 wherein said timer includes two distinct time delay operated switching mechanisms, the first of which is energized after a first time delay period, the second of which is energized during a second time delay period having a duration substantially less than said first time delay period, said second switching mechanism being controlled by said first switching mechanism and controlling said control mechanism.

8. The control system of claim 1 including:

(m) fifth sensor means providing an output signal representative of a condition sensed of the space to be cooled;

(n) third amplifier means operably connected to said fifth sensor means providing an amplified signal representative of the condition sensed of the space to be cooled;

(o) and a high signal selector means operably connected to said third amplifier means and interconnected between said lower signal selector and said dual input settable controller to provide an output signal representative of the highest amplitude of said temperature signals and said signal representative of the condition sensed in the space to be cooled.

9. The control system of claim 8 wherein said third amplifier means is a settable controller.

10. The control system of claim 8 wherein said third amplifier means has operating characteristics including proportional bands of operation.

11. The control system of claim 10 wherein said proportional bands of operation are distinct for each of said amplifier means and said settable controllers.

12. The control system of claim 10 wherein each of said proportional bands of operation are settable to different operating conditions.

13. A control system for an absorption type refrigeration system using a refrigerant to chill a fluid medium through a closed system having an evaporator adapted to receive said fluid medium, said evaporator being in communication with an absorber, said absorber including means for cooling said absorber to produce a dilute solution from a concentrated solution, a concentrator in communication with said evaporator for providing a concentrated solution from said dilute solution; a source of heat in communication with said concentrator, a heat control device controlling the flow of heat to said concentrator and a control means for controlling the concentration of the concentrated solution applied to the absorber, said control means comprising:

(a) first temperature sensor means providing an output signal representative of the outside air temperature;

(b) first amplifier means operably connected to said first sensor means providing an amplified signal represenative of the outside air temperature;

(c) second temperature sensor means providing an output signal representative of the return chilled water temperature;

(d) second amplifier means operably connected to said second sensor means providing an amplified signal representative of the returned chilled water temperature;

(e) a low signal selector means operably connected to said first and second amplifier means providing an output sign representative of the lowest amplitude of said temperature signals;

(f) third temperature sensor means providing an output signal representative of the supply chilled water temperature;

(g) a dual input settable controller operably connected to said third temperature sensor and to said low signal selector means to provide an output signal representative of the increase or decrease in amplitude from the set point of said settable controller;

(h) fourth sensor means sensing one of three mediums including two different temperatures or a pressure, the temperatures being representative of a strong solution temperature or a condenser temperature and the pressure being representative of the cooling water output pressure, said sensor providing an output signal representative of one of said mediums;

(i) a reverse signal settable controller operably connected to said fourth sensor means and to said dual input settable controller providing a signal representative of the reverse change in amplitude from the set point of said reverse signal settable controller;

(j) and a control mechanism having an input operably connected to said reverse signal settable controller and an output operably connected to the heat control device, said control mechanism providing a signal representative of the heat requirement of said absorption type refrigeration system.

14. The control system of claim 13 wherein the output signal of said fourth sensor means is used as an overriding signal regardless of the magnitude of the output signals representative of the conditions sensed by said first, second, and third temperature sensor means.

15. The control system of claim 13 including:

(k) humidity sensor means providing an output signal representative of the relative humidity of the ambient air of the space to be cooled;

(l) third amplifier means operably connected to said humidity sensor means providing an amplified signal representative of the relative humidity of the space to be cooled;

(m) and a high signal selector means operably connected to said third amplifier means and interconnected between said low signal selector and said dual input settable controller to provide an output signal representative of the highest amplitude of said temperature signals and said signal representative of the relative humidity.

16. The control system of claim 15 wherein the output signal representative of relative humidity is used as an overriding signal regardless of the amplitude of the output signals representative of the other conditions sensed by said other sensor means.

17. The control system of claim 13 or 15 including:

(n) a directional signal mechanism connected in parallel with the input and output of said control mechanism to equalize the amplitude of said signal at the output with that of the input;

(o) a timer operably connected to said control mechanism for alternately interrupting the signal from said reverse signal settable controller and enabling said directional signal mechanism.

18. The control system of claim 17 wherein said timer includes two distinct time delay operated switching mechanisms, the first of which is energized after a first time delay period, the second of which is energized during a second time period having a duration substantially less than said first time period, said second switching mechanism being controlled by said first switching mechanism and controlling said control mechanism.

19. The control system of claim 17 including:

(p) a demand controller interconnected between said control mechanism and the heat control device for reducing the magnitude of any output signal from said control mechanism upon said output signal reaching a predetermined magnitude.

20. A control means for a refrigeration system using a refrigerant to chill a fluid medium through a closed system having a chiller and a condenser, the chiller receiving the fluid medium to be chilled and discharging the fluid medium upon being chilled, a compressor in communication with the chiller and condenser to provide refrigeration to chill the fluid medium in the chiller, a refrigerant flow device varying the refrigerant flow to the compressor for controlling the refrigeration capacity of the refrigeration system, a positioning mechanism operably connected to the refrigerant flow device in response to the output of a control means, said control means comprising:

(a) first temperature sensor means providing an output signal representative of the outside air temperature;

(b) first amplifier means operably connected to said first sensor means providing an amplified signal representative of the outside air temperature;

(c) second temperature sensor means providing an output signal representative of the return chilled water temperature;

(d) second amplifier means operably connected to said second sensor means providing an amplified signal representative of the returned chilled water temperature;

(e) a low signal selector means operably connected to said first and second amplifier means providing an output signal representative of the lowest amplitude of said temperature signals;

(f) third temperature sensor means providing an output signal representative of the supply chilled water temperature;

(g) a dual input settable controller operably connected to said third temperature sensor and to said low signal selector means to provide an output signal representative of the increase or decrease in amplitude from the set point of said settable controller;

(h) fourth temperature sensor means providing an output signal representative of the condenser temperature;

(i) a reverse signal settable controller operably connected to said fourth temperature sensor means and to said dual input settable controller providing a signal representative of the reverse change in amplitude from the set point of said reverse signal settable controller;

(j) and a control mechanism having an input operably connected to said reverse signal settable controller and having an output operably connected to the positioning mechanism, said control mechanism providing a signal representative of the capacity of said refrigeration system.

21. The control system of claim 20 including:

(k) a directional signal mechanism connected in parallel with the input and output of said control mechanism to equalize the amplitude of said signal at the output with that of the input;

(l) a timer operably connected to said control mechanism for alternately interrupting the signal from said reverse signal settable controller and enabling said directional signal mechanism.

22. The control system of claim 21 wherein said timer includes two distinct time delay switching mechanisms, the first of which is energized after a first time delay period, the second of which is energized during the second time delay period having a duration substantially less than said first time delay period, said second switching mechanism being controlled by said first switching mechanism and controlling said control mechanism.

* * * * *